US010501887B2

(12) United States Patent
Carter

(10) Patent No.: US 10,501,887 B2
(45) Date of Patent: Dec. 10, 2019

(54) JACKETED WIRE ROPE

(71) Applicant: Bonita Carter, Victoria (CA)

(72) Inventor: Bonita Carter, Victoria (CA)

( * ) Notice: Subject to any disclaimer, the term of this patent is extended or adjusted under 35 U.S.C. 154(b) by 131 days.

(21) Appl. No.: 15/602,987

(22) Filed: May 23, 2017

(65) Prior Publication Data

US 2018/0251940 A1 Sep. 6, 2018

(30) Foreign Application Priority Data

Mar. 3, 2017 (CA) ..... 2959900

(51) Int. Cl.
*D07B 1/06* (2006.01)
*D07B 7/12* (2006.01)
(Continued)

(52) U.S. Cl.
CPC ..... *D07B 1/0686* (2013.01); *D07B 1/167* (2013.01); *D07B 5/006* (2015.07); *D07B 7/12* (2013.01); *D07B 7/14* (2013.01); *D07B 2201/2049* (2013.01); *D07B 2201/2059* (2013.01); *D07B 2201/2065* (2013.01); *D07B 2207/4059* (2013.01); *D07B 2801/24* (2013.01)

(58) Field of Classification Search
CPC ..... D07B 1/06; D07B 1/0673; D07B 1/0686; D07B 1/167; D07B 1/165; D07B 5/00; D07B 5/006; D07B 7/12; D07B 7/14; D07B 2201/2047; D07B 2201/2048; D07B 2201/2049; D07B 2201/2052; D07B 2201/2059; D07B 2201/206; D07B 2201/2061; D07B 2201/2062; D07B 2201/2065; D07B 2207/4059; D07B 2801/24
See application file for complete search history.

(56) References Cited

U.S. PATENT DOCUMENTS 3,705,489 A 12/1972 Smollinger
3,800,522 A * 4/1974 Hughes ..... D07B 1/162 57/215
(Continued)

FOREIGN PATENT DOCUMENTS

CA 582779 A 9/1959
CA 716845 A 8/1965
(Continued)

OTHER PUBLICATIONS

ACP Composites "Large Stock of Ready to Use Composite Plate, Tube, Sheet, Fabrics and Core Materials", downloaded from www.acpsales.com/Core-Materials-and-Foam.html, Core Materials & Foam, Oct. 28, 2016; p. 1-4.
(Continued)

*Primary Examiner* — Ismael Izaguirre
(74) *Attorney, Agent, or Firm* — Seed Intellectual Property Law Group LLP

(57) ABSTRACT

A wire rope has a lubricated core, an inner jacket in contact with the core, and outer strands wrapped around the inner jacket. An outer jacket surrounds the outer strands and contacts the inner jacket to form an integrated jacket. A method of forming an integrated jacket for a wire rope in which an inner jacket is cold applied and an outer jacket is applied by application of molten material to the inner jacket.

45 Claims, 6 Drawing Sheets

(51) Int. Cl.

| | |
|---|---|
| ***D07B 7/14*** | (2006.01) |
| ***D07B 1/16*** | (2006.01) |
| ***D07B 5/00*** | (2006.01) |

(56) References Cited

U.S. PATENT DOCUMENTS

| | | | | |
|---|---|---|---|---|
| 3,824,777 | A | 7/1974 | Riggs | |
| 4,123,894 | A | 11/1978 | Hughes et al. | |
| 4,197,695 | A * | 4/1980 | Hughes | D07B 1/0673 156/433 |
| 4,606,183 | A * | 8/1986 | Riggs | D07B 1/144 57/217 |
| 4,609,515 | A | 9/1986 | Smyth | |
| 4,635,432 | A * | 1/1987 | Wheeler | B29B 15/122 57/221 |
| 4,667,462 | A | 5/1987 | Smyth | |
| 4,887,422 | A | 12/1989 | Klees et al. | |
| 5,269,128 | A | 12/1993 | Walton et al. | |
| 5,386,683 | A | 2/1995 | Misrachi | |
| 7,272,921 | B2 | 9/2007 | Misrachi | |
| 7,389,633 | B2 * | 6/2008 | Misrachi | D07B 1/165 57/223 |
| 9,428,858 | B2 | 8/2016 | Cavallin | |
| 2004/0006963 | A1 * | 1/2004 | Misrachi | D07B 1/144 57/223 |

FOREIGN PATENT DOCUMENTS

| | | |
|---|---|---|
| CA | 1007526 | 3/1977 |
| CA | 2846147 C | 12/2016 |
| WO | 2016/120237 A | 8/2016 |

OTHER PUBLICATIONS

How It's Made—Industrial Wire Ropes; Description of known process from www.youtube.com: Mar. 2012.

New England Foam "Filter Foam, Reticulated, PPI, Air, Water, Purification, UL94HF1", downloaded from www.newenglandfoam.com/filter.html, Oct. 28, 2016, p. 1-3.

"Metal Foam", downloaded from Wikipedia, en.wikipedia.org/wiki/Metal_foam, Oct. 28, 2016, p. 1-8.

Porex Filtration Group, "PE Material: Porex Porous Polyethylene for Plastic Filter Media", downloaded from www.porex.com/technologies/materials/porous-plastics/pe/, Apr. 27, 2017; p. 1-2.

DCL Dreyfus Cortney Lowery Mooring Rigging, "Plastic Impregnated Rope", downloaded from www.dcl-usa.com, Feb. 2017, p. 1.

GenPore—A Division of General Polymeric Corporation, "Porous Plastic Sheet", downloaded from www.genpore.com/porous_plastic_sheet.htm, Apr. 27, 2017, p. 1.

Barna, photo of Reticulated Polyurethane Foam Sheet lOppi, 20ppi, 30ppi, 35ppi, 50ppi, 60ppi, Nov. 2017; p. 1.

Wire Rope photo; Oct. 2017.

Product Catalog of WireCo, "TUF-MAX Wire Rope—Union Wire Rope", downloaded from www.unionrope.com/product-catalog/TUF-MAX, May 18, 2017, p. 1-2.

Wire Rope Products—Union Wire Rope, downloaded from www.unionrope.com/En/Product-Search?plastic, May 18, 2017, p. 1-3.

* cited by examiner

JACKETED WIRE ROPE

BACKGROUND

Technical Field

Jacketed wire rope and method of manufacture.

Description of the Related Art

Attempts have been made to impregnate wire rope with plastic materials in order to decrease wear and fatigue of the rope and increase its life. For example, Canadian Patent No. 582,779 describes vacuum impregnation of wire ropes with an elastomeric plastic material which is subsequently caused to undergo setting or gelation within the rope. Canadian Patent No. 716,845 describes a standard wire rope wherein synthetic plastic material is worked into the natural gaps in such a manner that it engages laterally in the gaps between the wires of the outer strands.

Canadian Patent No. 1,007,526 describes a method of impregnating lubricated wire rope with a thermoplastic material wherein the rope is first formed while coating the strands with a heavy viscous lubricant, then the lubricated rope is preheated and the outer strands of the wire rope are held spaced apart from one another. Finally, the rope is impregnated with a plastic composition so as to entrap the lubricant in the core and the strands. U.S. Pat. No. 4,667,462 notes disadvantages of Canadian Patent No. 1,007,526, including the risk of peeling of plastic material from poor adherence of the plastic material to the wire.

U.S. Pat. No. 3,705,489 discloses a plastic jacket around the core of wire ropes in an attempt to retain lubrication or prevent the escape of lubrication and to help reduce strand to strand contract by enhancing uniform strand spacing. A plastic impregnated rope process was disclosed in U.S. Pat. No. 5,386,683, involving encapsulating a core with a plastic jacket, and applying plastic fillings in gaps between the outer strands to create uniform gaps between strands while the rope is in operation.

BRIEF SUMMARY

In an embodiment, there is provided a wire rope, comprising a lubricated core, an inner jacket contacting the core, the inner jacket including an outward facing surface having open pores, outer strands wrapped around the inner jacket and an outer jacket at least partly permeating into the open pores of the inner jacket to form an integrated jacket formed of the inner jacket and the outer jacket.

In an embodiment, there is provided a method of constructing a wire rope from a core and outer strands, the core being lubricated, comprising applying an inner jacket by cold application to the core, the inner jacket being permeable and having pores or voids, closing the outer strands over the inner jacket to compress the inner jacket, and applying a molten material to the inner jacket to form an integrated jacket that includes the inner jacket.

In an embodiment, there is provided a method of constructing a wire rope from a core and outer strands, the core being lubricated, comprising: applying an inner jacket by cold application to the core, the inner jacket being permeable and having pores or voids; closing the outer strands over the inner jacket and applying a molten material to the inner jacket at a temperature and pressure sufficient to cause the molten material to contact the inner jacket to form an integrated jacket that includes the inner jacket. The inner jacket may at least partly surround the outer strands to separate the outer strands. The inner jacket may have an equal or higher melting point than the molten material. The molten material may migrate into pores or voids of the inner jacket such that the molten material cools as the molten material passes through the pores or voids of the inner jacket. Applying the molten material to the inner jacket may be carried out before, during or simultaneously with closing of the outer strands over the inner jacket. The inner jacket may have a porosity above 5 PPI and below about 30 PPI, 50 PPI, 80 PPI or 150 PPI before closing of the outer strands over the inner jacket and a lower porosity afterward.

In various embodiments, there may be included any one or more of the following features: the inner jacket is formed of a material with a first melting point, the outer jacket is formed of a material with a second melting point; and the melting point of the material of the inner jacket is higher than the melting point of the material of the outer jacket; the inner jacket is porous, and the outer jacket contacts and enters into the pores or voids of the inner jacket; the inner jacket forms a matrix; the inner jacket is formed by crossing fibrous material; the inner jacket is formed by grids of material laid on top of each other; the inner jacket is permeable, and the outer jacket permeates at least partly into the inner jacket; the molten material of the outer jacket fills gaps between outer strands; the outer jacket surrounds the outer strands; the inner jacket is compressed by the outer strands; the inner jacket is made of plastic; the inner jacket is made of metal; the inner jacket is tubular; the core is an independent wire rope core; the outer strands, the core or wires of either or both are galvanized; the inner jacket includes an impermeable layer; the impermeable layer forms a floor adjacent the core or a layer within the inner jacket; the inner jacket has layers of different permeability; the outer jacket is made of plastic; the plastic of the outer jacket comprises one or more of polyethylene, polyethylene terephthalate, polypropylene, polyamide, polyimide, polyurethane, polytetrafluorethylene, polyvinyl indene, ethyl vinyl acetate, polycarbonate (and alloys), nylon, polysulfone and aramid fiber.

In various embodiments, there may be included any one or more of the following steps: further comprising compressing the inner jacket with the outer; closing the outer strands is simultaneous with the step of applying the molten material to the inner jacket; galvanizing wires of the outer strands; and the inner jacket is tubular prior to application to the core.

These and other aspects of the device and method are set out in the claims.

BRIEF DESCRIPTION OF THE SEVERAL VIEWS OF THE DRAWINGS

Embodiments will now be described with reference to the figures, in which like reference characters denote like elements, by way of example, and in which.

DETAILED DESCRIPTION

Immaterial modifications may be made to the embodiments described here without departing from what is covered by the claims. In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

Figure 1:
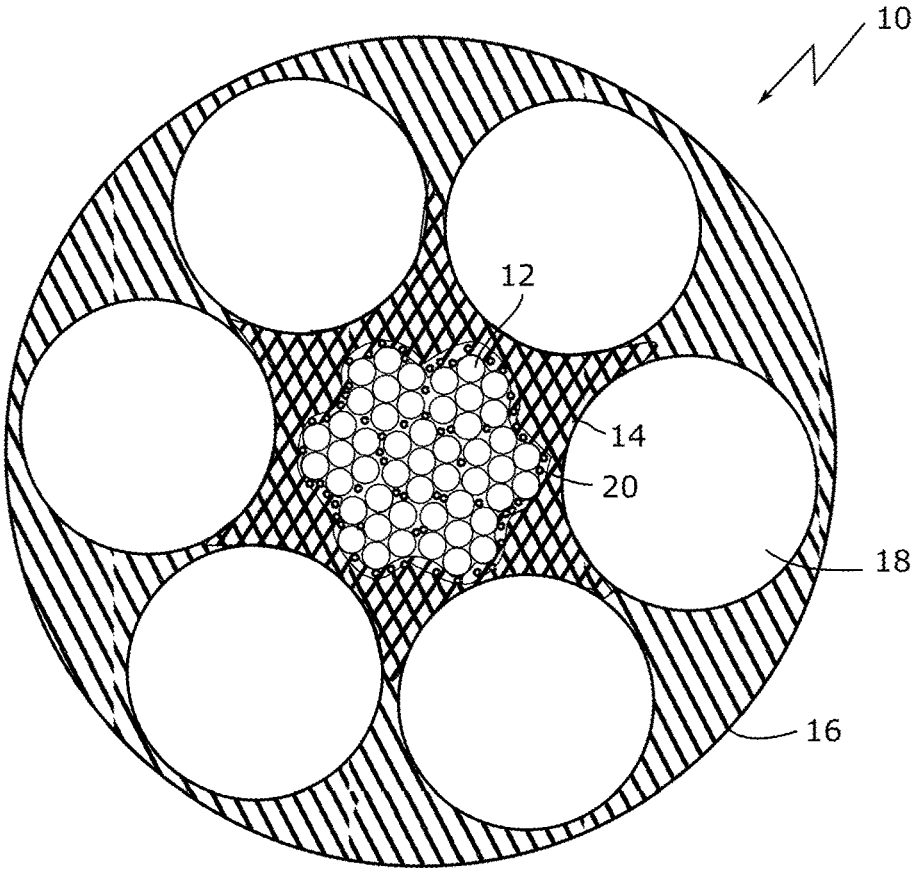
FIG. 1 is a cross-section view of an embodiment of a wire rope.
Figure 2:
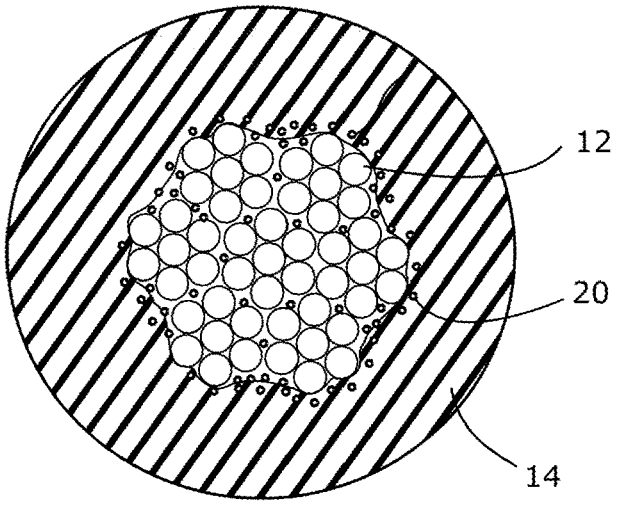
FIG. 2 is a cross-section view of an embodiment of a wire rope before the outer jacket and outer strands have been applied.

As shown in FIGS. 1 and 2, an embodiment of a wire rope 10 has a lubricated core 12, which may be for example an independent wire rope core, a strand core, a fiber core or a plastic core. The lubricated core 12 has an indented profile including indentation between strands of the core and between wires forming the strands. An inner jacket 14 contacts the core 12 and completely surrounds the core 12. A plurality of outer strands 18 is wrapped around the inner jacket 14. A plastic outer jacket 16 at least partly surrounds the outer strands 18 and contacts the inner jacket 14 to separate the outer strands from each other. The inner jacket 14 may have a higher melting point than the outer jacket 16. In some embodiments, the inner jacket 14 may have the same melting point as or a lower melting point than the outer jacket 16. The outer jacket 16 may sufficiently cover the outer strands 18 to prevent metal to metal contact between the outer strands that would cause premature wear on the outer strands 18 and to prevent migration of debris between the outer strands that might deteriorate the function of the wire rope.

Figure 4:
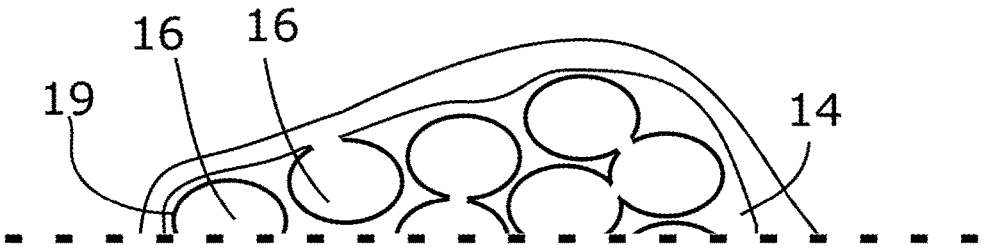
FIG. 4 is a cross-section view of part of an integrated jacket from an embodiment of a wire rope.

In an embodiment, the inner jacket 14 comprises a porous and permeable material with open pores 19 on the outward facing surface of the inner jacket 14. The outer jacket 16 contacts the pores 19 of the inner jacket 14, as shown in FIG. 4 and binds to material of the inner jacket 14 that defines the pores 19 of the inner jacket 14. FIG. 4 is representational. The pores 19 may all be connected, for example as shown in FIGS. 7A-7G. By contacting is meant that the outer jacket material at least is in physical contact with the inner jacket 14 and may enter into (impregnate) the open pores 19 of the inner jacket material to help form a bond between the inner jacket 14 and the outer jacket 16. The outer jacket 16 may penetrate the open pores 19 of the inner jacket to a greater extent than the inner jacket penetrates the indented profile of the core 12. This relative penetration of the outer jacket 16 into the inner jacket 14 compared with the penetration of the inner jacket 14 into the core 12 may be facilitated by the relative melting temperatures of the outer jacket 16 and inner jacket 14.

The material forming the plastic outer jacket 16 may extend a varying degree into the inner jacket 14, from filling some of the pores of the inner jacket 14 to filling all of the pores 19 of the inner jacket 14 (as illustrated in FIG. 1). In some embodiments, the plastic of the outer jacket 16 may extend inwardly through the inner jacket 14 into the core 12. The combined inner jacket 14 and outer jacket 16 together form a single integrated jacket for the wire rope. FIG. 4 shows a cross-section of part of an integrated jacket in which the outer jacket 16 has filled the pores 19 of the inner jacket 14.

The inner jacket 14 may be compressible and compressed by the laying of the outer strands 18 on the inner jacket 14. The outer strands 18 may be compressed against the inner jacket 14. FIG. 2 shows the inner jacket 14 surrounding the core 12 before compression. The compression of the outer strands 18 may result in the inner jacket 14 being compressed or crushed into a new shape and forced into voids and gaps within the wire rope. The voids and gaps may for example be gaps between each of the outer strands 18, between the outer strands 18 and the core 12, and between strands and wires of the core 12. The compression of the inner jacket 14 into gaps of the wire rope may prevent strand to strand or core to strand contact.

The outer jacket 16 may be impregnated or injected on to the surface of and into the inner jacket 14 surrounding the core 12 and into the outer strands 18 as a molten material that passes through the outer strands 18 to the inner jacket 14. The molten material may be applied to the surface of the inner jacket 14 surrounding the core 12 and outer strands 18 before or simultaneously with closing the outer strands 18 around the inner jacket 14. The outer strands 18 may be wrapped around the outer jacket 16 and compressed against the inner jacket 14, forcing the material of outer jacket 16 to spread in between the outer strands 18 and into the inner jacket 14.

The inner jacket 14 may for example be made of metal or plastic. A plastic inner jacket 14 may be made from any suitable material including one or more of polyamide plastics, polyimide, nylons such as nylon 6, neoprene, ethyl vinyl acetate, aramid fibers such as Kevlar™ fibers, synthetic aromatic polyamide polymer, and polymers in fiber, sheet or block form such as polyethylene, polyester including liquid crystal polyester, polyethylene terephthalate, polypropylene, polyamide, polyurethane, polytetrafluorethylene, polyvinyl indene, polycarbonate (and alloys) and polysulfone. The inner jacket 14 may for example be reticulated filter foam. A metal inner jacket 14 may for example be formed of fibers or foams made of tin, aluminum, copper, steel, or iron, and may be stainless steel or contain galvanized wires. The material of the inner jacket 14 may also be enhanced metal, a hybrid metal material, glass or metal sponge, for example, copper. Use of strong fibers such as aramid fibers for the inner jacket 14 may be useful in strengthening the pore walls to combat deterioration of the wire rope during use of the wire rope.

The inner jacket 14 may be permeable, such that molten plastic and wire rope lubrication may move through the inner jacket 14 when the inner jacket 14 is closed over the core 12 of the wire rope. The inner jacket may be porous, such that the inner jacket includes pores, or may form a matrix, be formed by crossing fibrous material or layering grids of material, each of which may have voids such as holes or openings which may allow fluid to permeate through the inner jacket 14. The holes of the matrix, crossed fibrous material or layered grids may be interconnected such that liquid may pass through holes from one side of the matrix, crossed fibrous material or layered grids to the other side. The pores or holes may be occupied by molten or solidified plastic of the outer jacket 16 or core lubricant or both. The outer jacket 16 may permeate partly or fully into the inner jacket 14. By matrix is meant that material is interlaced to form a structure having spaces between the interlaced materials. By crossed fibrous material is meant that lengths of fibrous material are crossed at angles with each other to form a network, such as for example a grid.

The inner jacket 14 may provide a protective layer between the lubrication of the core 12 and the heat required to impregnate the outer strands 18 with the outer jacket 16. The inner jacket 14 material may have a melting temperature high enough to prevent displacement or removal of the lubricant. The inner and outer jackets together form a unified jacket which may provide cushioning for the wire rope to absorb friction and vibration. This unified jacket acts as a separator between the strands to prevent strand contact and abrasion. The unification of the inner jacket 14 and the outer jacket 16 to form an integrated jacket anchors the outer jacket 16 within the wire rope 10.

The core 12 is filled with lubricant 20 prior to application of the inner jacket 14 around the core 12 and prior to the application of the outer jacket and closing the outer strands 18 around the core. The lubricant 20 may be for example hot applied (petroleum based) or cold applied (asphalt based) or may be a synthetic lubricant such as silicones, diesters, phosphate esters, polyglycols, fluorocarbons, and polyphenyl ethers. In some embodiments, when the outer jacket 16 is applied, the outer jacket material may flow through pores or holes of the inner jacket and in and around the outer strands 18 inwardly into the inner jacket 14 through the pores until it reaches the outer surface of the core 12. The lubricant may begin softening, melting or be forced upwards into the outer jacket material.

Figure 3:
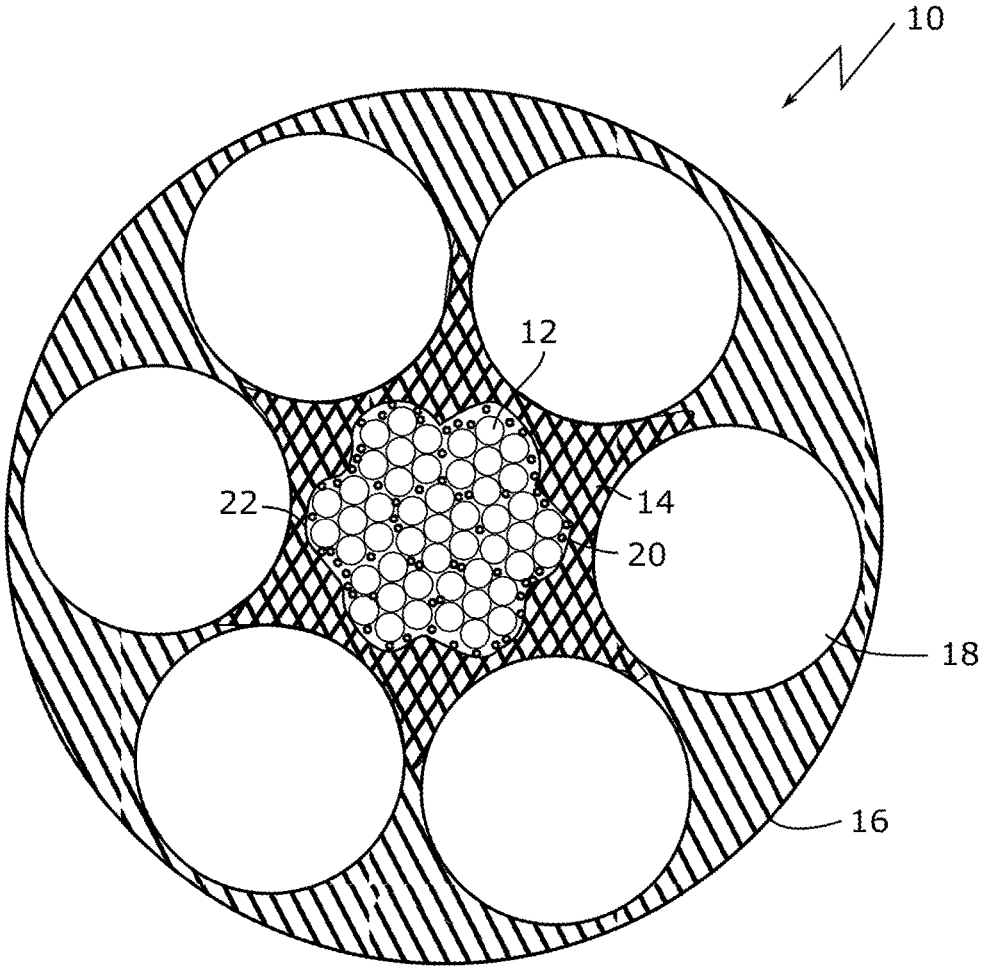
FIG. 3 is a cross-section view of a further embodiment of a wire rope.

The inner jacket 14 may have an impermeable floor, membrane or base 22 adjacent the core 12 which traps lubrication within the core 12, or impedes movement of lubrication from the core 12. In some embodiments, the jacket floor 22 is impermeable, as shown in FIG. 3, and may for example be closed celled to prevent lubrication migration. In other embodiments, the floor 22 may be open celled to permit limited lubrication movement into the pores of the inner jacket. In some embodiments, the floor is slightly permeable, less permeable than the inner jacket 14 for example by having small connected pores or holes to permit small amounts of lubricant 20 to pass into the inner jacket. In some embodiments, the floor is porous and has a different porosity from that of the inner jacket 14. Lubrication of the core 12 helps to extend the working life of the wire rope 10. The unified jacket may provide a barrier to prevent as much as practically possible the lubrication from escaping the wire rope 10. The floor 22 may be made of one or more materials, such as two different plastics, of differing porosity and/or permeability, or the same material with portions having different porosity and/or permeability. The floor 22 may thus have an inner portion and outer portion. One or both of the inner portion and the outer portion of the floor 22 may be impermeable.

In some embodiments, the materials of the inner jacket 14 may be absorbent only by means of being porous, such that the many pores receive liquid in them, or by forming matrix, lattice or framework having holes which may fill with liquid. The pores (or holes or openings) 19 of the inner jacket 14 may be of different shapes and sizes, and may be randomly placed or organized for example linearly or in layers. For example, the pores 19 may be circular, square, or rectangular. The inner jacket 14 may have between 150 pores per inch (PPI) and 5 PPI, or between 50 PPI and 5 PPI but more or fewer pores per inch may be used in some embodiments, for example between 5 PPI and 30 PPI or between 5 PPI and 80 PPI. Multiple instances of inner jacket 14 may be applied to wire rope 10. The pore size is calculated as the average pre-compressed size of the pores before the inner jacket has been compressed by laying of the outer strands on the inner jacket, and after closing of the outer strands over the inner jacket may then have a lower porosity. The average pore size may be compressed for example by a factor of 2:1, 3:1 or 4:1 or less or more with a corresponding reduction in the volume of the inner jacket 14.

Figure 7A:
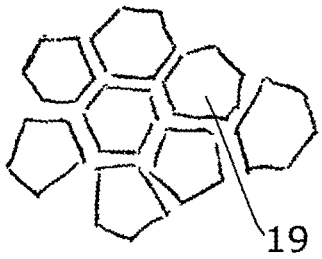
FIGS. 7A-7G show examples of forms of the inner jacket.
Figure 7B:
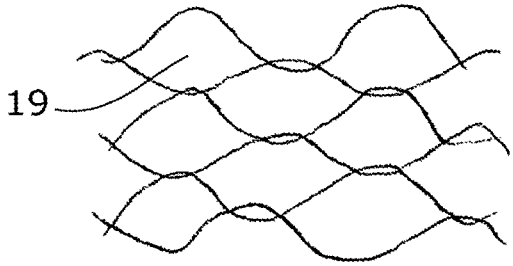
Figure 7C:
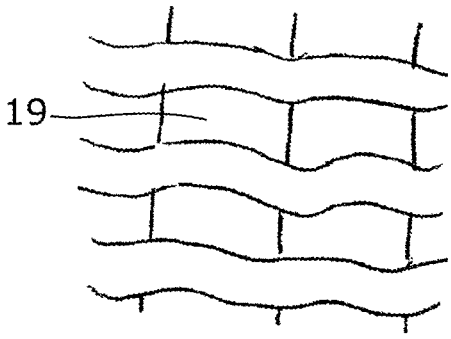
Figure 7D:
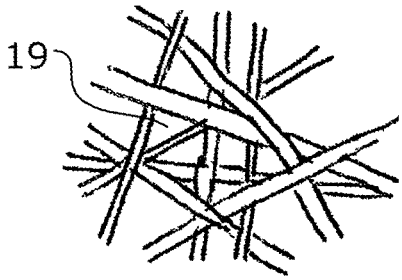
Figure 7E:
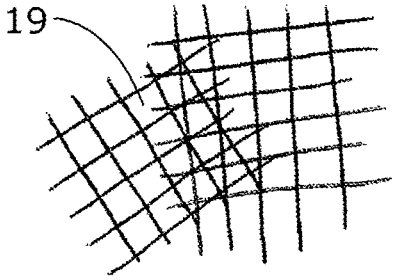
Figure 7F:
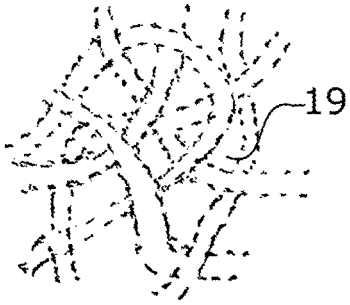
Figure 7G:
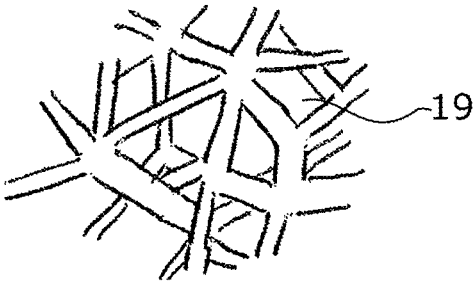

The pores may have an open cell configuration. The inner jacket 14 for example may have a honeycomb shape, or may be sponge-like, netted, webbed, meshed or grated. The inner jacket 14 may be formed of a network of connecting threads, walls or netting, such as in a scrubbing sponge or filter. The inner jacket may be a combination of any of the above forms, and may also be a combination of the above forms and any one or more of a matrix, crossed fibrous material or layered grids. FIGS. 7A-7G shows examples of some possible forms of the inner jacket 14 that may form a permeable porous material, for example honeycomb (FIG. 7A), netted (FIG. 7B), webbed (FIG. 7C), a matrix of fibers (FIG. 7D), layered grids (FIG. 7E), crossed fibrous material (FIG. 7F) and a matrix of branched material (FIG. 7G). Pores 19 of the material may be interconnected to varying degrees.

The inner jacket 14 may be installed as a single layer or may have multiple layers having different permeability to provide different levels of penetration of the lubricant and plastic outer jacket 16. An inner jacket 14 may be applied inside the core 12, for example to the core nucleus. Various inner jackets 14 may be integrated into the core and may extend out of the core to surround the core. Each inner jacket 14 may be impregnated with outer jacket 16. The inner jacket 14 may be formed of multiple layers of different materials, such as a plastic-metal-plastic layered configuration. The inner jacket 14 may be pre-formed to have an exterior profile that conforms to the lay and dimension of the outer strands. Thus, for example the inner jacket 14 may be molded or cut to have a fluted exterior surface that is pre-formed with the same shape as the inner surface of the outer strands that close over the inner jacket. The outer strands may lie in the exterior profile of the inner jacket and become embedded in the shapes during closing of the outer strands. Likewise, the inner jacket 14 may be pre-formed to have an interior profile that conforms to the lay and dimension of the core strands. Thus, for example the inner jacket 14 may be molded or cut to have a fluted interior surface that is pre-formed with the same shape as the outer surface of the inner strands that the inner jacket closes over. This molded or preformed inner profile of the inner jacket 14 may conform to the shape of the strands of the core 12 but, due to being cold applied and difficulty in aligning precisely to the wires of the strands of the core 12 will not penetrate so greatly into indentations of the core as the outer jacket 16 penetrates into pores of the inner jacket 14.

The outer jacket 16 may be made of plastic (polymer). The outer jacket 16 may be impregnated into the pores of inner jacket 14 and on to the surface of inner jacket 14. The outer jacket 16 may be impregnated on the strands by extrusion of the hot plastic. The outer jacket may extend beyond the periphery of the closed outer strands 18 by a thickness of between 0.025"-0.060". The outer jacket may be concentric with the diameter of steel wire rope, or may be eccentric within a range of 0.025".

The outer jacket 16 may have a lower melting point than the material of the inner jacket 14 and is applied in a melted state to the inner jacket 14. The outer strands 18 and the inner jacket 14 may be filled by molten material that is used to form the outer jacket 16, which may prevent metal to metal contact between the outer strands 18 and adjacent outer strands 18, as well as between the outer strands 18 and the core 12. The gaps between the outer strands 18 may be filled by molten material used to form the outer jacket 16 during the closing of the outer strands 18 on to the core 12. The amount of outer jacket material required to fill voids will depend on the sizes of the outer strands 18 and core 12. The impregnation of the inner jacket 14 with the outer jacket 16 may be performed under pressure by specialized extrusion equipment. For example, where the outer jacket 16 is made of polypropylene, pressure may be applied in the range of 10-30 MPa, and have a plastic melting temperature of −200° C. The pressure at which the outer jacket 16 is extruded is adjusted based on the desired amount of infiltration of the outer jacket 16 into the inner jacket 14. The pressure may depend on the lay length of the wire rope 10, the thickness of the inner jacket 14, the viscosity of the molten plastic, and the type of regulator that performs the extrusion. The temperature to which the outer jacket 16 is heated for extrusion will be greater than the melting temperature of the material of the outer jacket 16

The molten material used to form the outer jacket 16 passes through the network of pores to adhere and anchor to the inner jacket 14. The combination of the inner jacket 14 and outer jacket 16 forms a seal against lubricant leaving the core 12. Effectively, the application of the molten material to the outer strands 18 and the inner jacket 14, followed by the cooling of the molten material to solidify between the outer strands 18 and in pores of the inner jacket 14, creates a unified jacket around the core 12.

The outer strands 18 may be galvanized or contain galvanized wires. Galvanizing may promote plastic adherence and resistance to rust. Individual wires forming the outer strands 18 may also be galvanized. In embodiments where the core 12 includes core strands, the core strands or individual wires in the core strands may be galvanized.

The molten material may be of a temperature that causes some melting of the inner jacket 14, provided that application of the molten material does not burn or melt off all lubricant 20.

Figure 5:
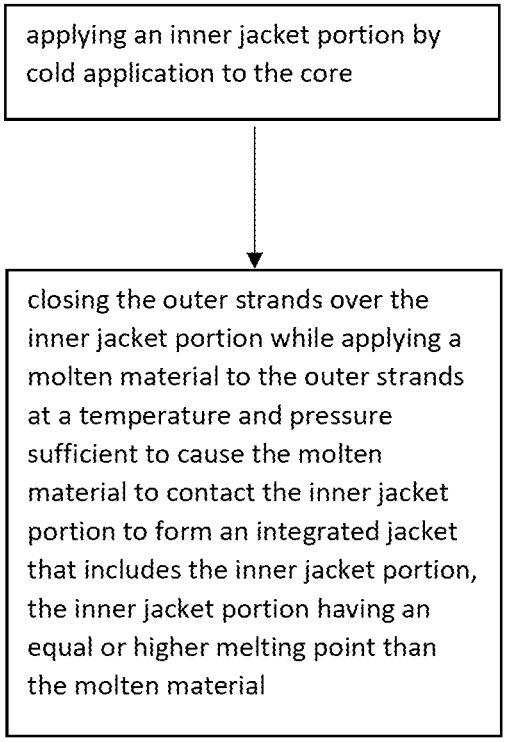
FIGS. 5 and 6 are flow charts of the steps of the independent method claims.

In FIG. 5, a flow chart of a method of constructing a wire rope 10 from a lubricated core 12 and plural outer strands 18 is shown. The method includes the following steps: applying an inner jacket 14 by cold application to the core 12; and closing the outer strands over the inner jacket 14 while applying a molten material to the outer strands 18 or the inner jacket 14 or both at a temperature and pressure sufficient to cause the molten material to contact the inner jacket 14 to form an integrated jacket that includes the inner jacket 14 and that at least partly surrounds the outer strands 18, the inner jacket 14 having an equal or higher melting point than the molten material.

Figure 6:
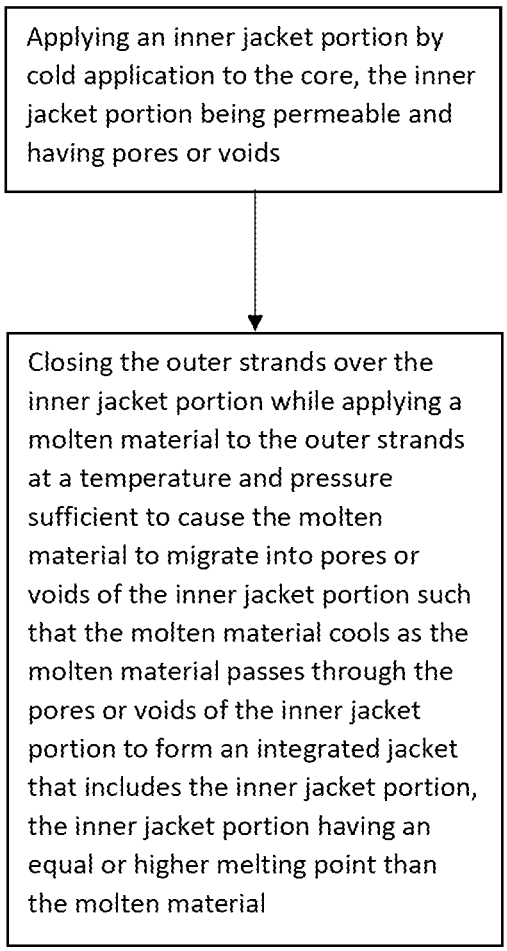

In FIG. 6, a flow chart of a method of constructing a wire rope 10 from a lubricated core 12 and plural outer strands 18 is shown. The method includes the following steps: applying an inner jacket 14 by cold application to the core 12, the inner jacket being permeable and having pores or voids; and closing the outer strands 18 over the inner jacket 14 while applying a molten material to the outer strands 18 at a temperature and pressure sufficient to cause the molten material to migrate into pores or voids of the inner jacket 14 such that the molten material cools as the molten material passes through the pores or voids of the inner jacket 14 to form an integrated jacket that includes the inner jacket 14, the inner jacket 14 having a higher melting point than the outer jacket 16. The outer jacket 16 may be impregnated into the inner jacket 14 under pressure by specialized extrusion equipment. Application of the molten material may be directed first to the inner jacket 14 prior to closing of the outer strands, and may also be applied during the closing of the outer strands.

The voids in the inner jacket may be the result of the inner jacket being in the form of a matrix, crossing fibrous material or layering grids of material, each of which may have voids such as holes or openings which may allow fluid to permeate through the inner jacket 14.

Cold application means sufficiently cool that the application of the inner jacket does not cause lubrication loss in or on the core, and may for example comprise application of the inner jacket without a separate heating step, and may comprise application of the inner jacket at an ambient temperature below 10° C., 20° C., 30° C. or 40° C.

The inner jacket 14 may be compressed by the outer strands 18 during closing of the outer strands 18 around the inner jacket 14 and core 12. Compressing the inner jacket 14 may deform the inner jacket 14 to force the inner jacket 14 into the gaps between adjacent outer strands 18 or the core 12. In some embodiments, plastic trapped within the pores of the inner jacket 14 is forced out during compression while the outer strands are closing around the inner jacket, and is forced into gaps and voids between strands and wires of the wire rope 10. Filling of gaps helps to reduce metal strand to strand contact and to increase anchoring of the integrated jacket.

The molten material may have an equal or lower melting temperature than the material of the inner jacket 14. In some embodiments, the inner jacket 14 has a lower melting temperature lower than that of the molten material being impregnated, but the melting point of the outer jacket material should not be so high as to entirely melt the inner jacket material. The molten material may be impregnated into the inner jacket 14 and the outer strands 18. The molten material may thus enter the pores of the inner jacket 14, and by filling a portion of the pores form a denser inner jacket 14. The pores of the porous material of the inner jacket 14 adhere to the molten material and anchor the inner jacket 14 to the molten material. The molten material may thus combine with the inner jacket material to form a combined network of the inner jacket 14 with the molten material. This application of the molten material to the inner jacket is believed to reduce lubricant removal which may occur in typical plastic impregnation of wire ropes. The molten material cools to form outer jacket 16.

The densification of the inner jacket 14 using the molten material may increase the strength and interconnectedness of the inner jacket 14 to bind the wire rope together. As the molten material cools to form outer jacket 16, the pores entrap the plastic and are filled with outer jacket material which has moved around and in between the outer strands 18 and the core 12. The inner jacket 14 and outer jacket together form a unified, new jacket. The inner jacket 14 may prevent the outer jacket from sloughing off between valleys of the outer strands 18 by promoting adherence of the outer jacket material to the inner jacket 14. The impregnation of the outer strands 18 with the outer jacket may result in the outer jacket surrounding the wire rope.

Lubrication may be contained in and around the core 12 by the inner jacket 14. The lubrication may improve the wear and fatigue resistance of the wire rope. The outer strands 18, the individual wires of the outer strands 18, or the core strands may be galvanized. The galvanizing of the outer strands 18 may enhance adherence of the outer strands 18 with the material of the outer jacket. The zinc coating may help hold the outer jacket in place and reduce the effects of moisture intrusion.

Closing the outer strands 18 on the inner jacket may occur before, with or after filling the outer strands 18 with molten material of the outer jacket. In some embodiments, the molten material is applied directly to the inner jacket prior to strand closure and/or during strand closure, or after strand closure. The outer strands may be spaced apart during the application of the molten material, for example by using a strand gap controller, such as is known in the art. In other embodiments, closing the outer strands 18 may be simultaneous with applying the molten material to the inner jacket 14. The molten material of the outer jacket 16 may be injected or impregnated into the outer strands 18. Filling or partially filling the inner jacket 14 with the outer jacket 16 may be through impregnation, and the impregnation may take place under pressure. The impregnation of the outer jacket on the outer strands 18 may occur with the outer jacket in a liquid molten state. The temperature of the molten outer jacket is higher than the melting point of the outer jacket material and lower than the melting temperature of the inner jacket 14. The molten outer jacket material may be forced into the open pores of the inner jacket 14 during impregnation to fill at least some of the pores of the inner jacket 14. Compression of the outer strands 18 towards the core 12 may also contribute to filling of the pores and the gaps between and within the core 12 and the outer strands 18. The thickness of the inner jacket 14 is dependent on the wire and strand diameters and the oversize tolerances of the wire rope 10.

The molten material which forms the outer jacket 16 may be made of plastic, such as for example polypropylene, polyurethane, polyethylene, polystyrene, nylon or tetrafluorethylene, which have the following melting points:

| Material | Melting point (Celsius) | Melting point (Fahrenheit) |
|---|---|---|
| POLYPROPYLENE (isotactic) | 171 | 340 |
| POLYPROPYLENE (commercial isotactic) | 160-68 | 320-331 |
| POLYETHYLENE (LD) | 198 | 325 |
| POLYETHYLENE (HD) | 240 | 400 |
| POLYSTYRENE | 234 | 390 |
| NYLON | 260-273 | 500-525 |
| TETRAFLUORETHYLENE | 224 | 142 |

For example, commercial isotactic polypropylene may be used to form the outer jacket 16, which melts at between 160-168° C. The polypropylene may then be extruded at a temperature in the range of 190° C. to 210° C., such as for example 200° C., which may vary by several degrees depending upon the physical makeup and melting point of the inner jacket 14.

Prior to application of the inner jacket 14 to the core 12, the inner jacket 14 may have a variety of shapes, including for example tubular or flat (blanketed or Kevlar™ type), and may be for example a tube, sheet, roll or sleeve. Strips may be applied along the entire length of the wire rope, providing the inner jacket entirely surrounds the core. The inner jacket 14 may be wrapped around the core 12. The inner jacket 14 may be a sock. A tubular jacket may have a split to allow easy opening of the jacket so that it may fitted or snapped around the core 12. Multiple tubular jackets may be used to cover the core 12 of the entire rope.

The core, which may be for example IWRC, hybrid or enhanced core, and the core strands may be swaged, by a hammering method, such as is described in U.S. Pat. No. 9,428,858. The core 12 may be manufactured by a method that requires die or roller preforming or compacting of the individual wires that make up each of the strands. For example, a wire rope may have a diameter of 2¾" with an IWRC and 8 outer strands 18 laid about the core 12, with the core 12 being 1.58" and each of the outer strands 18 approximately 0.56" each. In this example, the impregnated inner jacket 14 may have minimum radial thickness of approximately 0.1" to 0.6". The core may be a strand core or any combination of strands such as a four strand core; it can also be a polymer or plastic core or combination of steel, other metal, or any plastic polymer. A FC (fiber core) may also be used.

The inner jacket 14 may surround the core 12 to a maximum thickness of anywhere from 1 cm or less to 30 cm or more depending on the finished diameter of the wire rope. The inner jacket may also be formed of more than one layer of material, such as grids overlying each other. The diameter of the core may be reduced depending on the size of the inner jacket in order to obtain a desired finished rope diameter. The core 12 can be manufactured using a wide range of constructions, such as for example 6×31 or 9×40, or 9×41, for example as disclosed in Canadian Patent No. 2,846,147. The depth and volume of the inner jacket 14 is determined as per individual requirements. The dimensions of the individual strands, core, and finished wire rope may be the same as the corresponding dimensions of a standard rope without a jacket surrounding the core.

In a wire rope that has an inner jacket 14, the core 12 may be reduced in size compared to the core of a wire rope of the same size which does not have an inner jacket 14. The core 12 may be smaller than a normal core rope having the same outer dimensions in order to provide space for a thicker plastic jacket than would otherwise be permitted by the rope structure. For example, the diameter of the core 12 of the wire rope, whether the core 12 is IWRC or a wire strand core, can be reduced as much as 15 to 17 percent from the normal size in a rope of comparable diameter, without significantly reducing the overall strength if the wire rope. An integrated inner jacket 14 and outer jacket having a thickness sufficient to increase the core size from 20 to 25 percent may be placed over the lubricated core. The outer strands 18 may seat into the intermingled inner and outer jacket, for example through compression of the outer strands. Spacing of the outer strands may be required during impregnation of the material of the outer jacket to allow the material of the outer jacket to infiltrate the pores of the inner jacket. The spacing may occur during closing of the outer strands over the inner jacket.

Wherever a "core" is referred to herein, the core may include any typical core such as a wire strand core or IWRC, and may also include a core and one or more layers of strands. The interconnected inner and outer jacket may be applied at multiple stages between various layers of a wire rope.

In an embodiment, the wire rope is shovel mining rope, which may for example be a 2¾" (70 MM) EP8×K36WS+IWRC. Examples of IWRC cores may be 6×31, 6×26. Other cores may be K9W, K12W core or 4SC core for example.

Prior to application of the outer jacket 16, the inner jacket 14 is sufficiently flexible to permit compression and stretching of the inner jacket 14. The pores of inner jacket 14 may be connected to each other durably such that stretching and compression of the inner jacket 14 does not break apart the pores of the inner jacket 14. The jacket pores may be sufficiently flexible to be compressed into gaps and voids between strands.

The molten material of the outer jacket 16 may cause melting or softening of the membranes of the pores. Control is exercised over the thickness of the lubrication and thickness of the inner jacket, pore size, and viscosity of the molten jacket to limit or control melting of the pores of the inner jacket and lubrication loss. Complete removal of lubrication is prevented.

The outside jacket in its finished state can be very thin, or not completely enclose the outer strands. In some embodiments, the outer top (known as 'hills') portion of the strands may not be covered by the outer jacket. In some embodiments, enough plastic is used for the outer plastic jacket material to fill the gaps between the outer strand knowns as the 'valleys.' For example, a millimeter or more of the steel of the outer strands may extend radially outward beyond the outer jacket.

In an exemplary embodiment, a core with eight outer strands is lubricated. An inner jacket is cold applied around the core. The inner jacket is impregnated with a molten plastic outer jacket, and simultaneously additional outer strands are closed around the inner jacket forcing the inner jacket towards the and into the outer strands. The plastic outer jacket fills the pores of the inner jacket and the voids between strands and the application of the outer jacket is completed when the outer jacket reaches the outer surface of the additional outer strands. The completed wire rope goes through a wiping, cooling and smoothing machine.

The first jacket with an open cell with floor configuration may provide a seal over the core to keep critical lubrication from escaping. In this embodiment, the lubrication is locked permanently within the wire rope core by the floor. The second jacket (impregnated) integration with the first jacket may provide a solid dense and relatively flexible padding between all strands where they may come into contact with each other. The jacket also forms around the core to ensure the seal is not broken during use causing lubrication escape. The first porous jacket thus not only prevents the lubrication from escaping from the core but also acts as a cushion and vibration damper between the outer strands of the rope and the core between the outer strands.

The inner jacket 14 may be secured on the core by various means such as adhesive, tape or removable hook and loop fasteners such as Velcro™.

Figure 8:
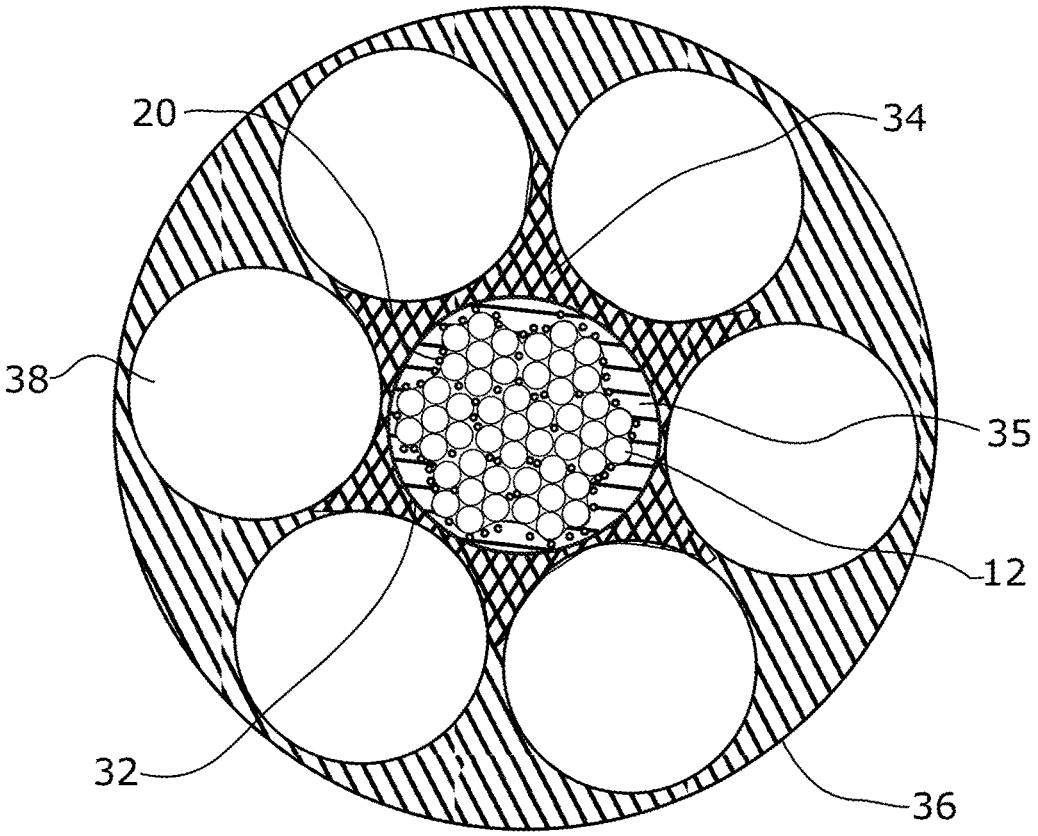
FIG. 8 shows a section of a wire rope having a floor or impermeable layer within the inner jacket, so that the inner jacket has inner and outer parts.
Figure 9:
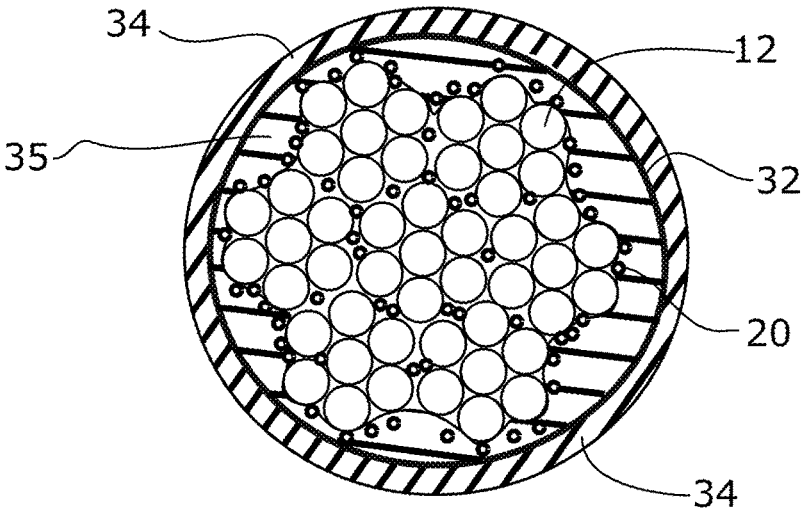
FIG. 9 shows a section of the wire rope of FIG. 8 before the outer strands are laid on the inner jacket.

As shown in FIG. 8, a wire rope 30 may have a core 12 with lubrication 20. An inner part 34 of a porous inner jacket may be laid on the core 12 and faces on to the core 12. The inner part 34 may be made in accordance with any of the inner jackets 14. An impermeable membrane or barrier 32 overlays the inner part 34, and may be formed integrally with the inner part 34, but may also be a separate element. An outer part 35 of a porous inner jacket may overlay the impermeable membrane 32. Outer strands 38 as shown in FIG. 9 may be compressed onto the outer part 35 and molten polymer applied before, with or after the outer strands 38 to fill or partly fill the pores of the outer part 35 of the porous inner jacket to form an outer jacket 36 that is integrated with the outer part 34 of the inner jacket. The impermeable membrane or barrier 32 may be made of a polymer that molten material of the outer jacket 36 and lubrication will not pass through. The molten material of the outer jacket 36 may be any of the materials mentioned as being suitable for the outer jacket 16. Lubrication may enter the pores of the inner part 34 of the inner jacket but are prevented from moving beyond the impermeable barrier 32.

The various embodiments described above can be combined to provide further embodiments. All of the U.S. and foreign patents referred to in this specification are incorporated herein by reference in their entirety. Aspects of the embodiments can be modified, if necessary to employ concepts of the various patents to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

What is claimed is:

1. A wire rope, comprising:

a lubricated core;

an inner jacket contacting the core, the inner jacket including an outward facing surface having open pores;

outer strands wrapped around the inner jacket; and an outer jacket at least partly permeated into the open pores of the inner jacket to form an integrated jacket formed of the inner jacket and the outer jacket, wherein the inner jacket includes an impermeable layer and the impermeable layer forms a floor formed adjacent to the core.

2. The wire rope of claim 1 wherein:

the inner jacket is formed of a material with a first melting point, the outer jacket is formed of a material with a second melting point, and the melting point of the material of the inner jacket is higher than the melting point of the material of the outer jacket.

3. The wire rope of claim 1 wherein the inner jacket comprises a matrix.

4. The wire rope of claim 1 wherein the inner jacket comprises crossing fibrous material.

5. The wire rope of claim 1 wherein the inner jacket i& comprises grids of material laid on top of each other.

6. The wire rope of claim 1 wherein the inner jacket comprises a permeable part, and the outer jacket fully permeates the permeable part of the inner jacket.

7. The wire rope of claim 1 wherein material of the outer jacket at least partly surrounds the outer strands to separate the outer strands.

8. The wire rope of claim 1 wherein the inner jacket is compressed by the outer strands overlying the inner jacket.

9. The wire rope of claim 1 wherein the inner jacket comprises a polymer.

10. The wire rope of claim 1 wherein the inner jacket comprises metal.

11. The wire rope of claim 1 wherein the core is an independent wire rope core.

12. The wire rope of claim 1 wherein the outer strands or core strands or both outer strands and core strands or wires of the outer strands or of the core strands or of both outer strands and core strands are galvanized.

13. The wire rope of claim 1 wherein the impermeable layer divides the inner jacket into an outer part that is integrated with the outer jacket and an inner part that faces on to the core.

14. The wire rope of claim 1 in which the inner jacket comprises layers of different permeability.

15. The wire rope of claim 13 wherein:

the inner jacket has at least a first layer having a first permeability and a second layer having a second permeability, the first layer is adjacent the core, and the first permeability is lower than the second permeability.

16. The wire rope of claim 1 in which the outer jacket fully surrounds the outer strands.

17. The wire rope of claim 1 wherein the outer jacket comprises a polymer.

18. The wire rope of claim 17 wherein the polymer of the outer jacket comprises polypropylene, polyethylene, polystyrene, nylon, or tetrafluorethylene.

19. The wire rope of claim 1 in which the inner jacket comprises aramid fibers.

20. The wire rope of claim 1 in which the material of the outer jacket penetrates all of the inner jacket.

21. The wire rope of claim 1 in which the lubricated core has an indented profile, and the outer jacket penetrates the open pores of the inner jacket to a greater extent than the inner jacket penetrates the indented profile of the core.

22. A method of constructing a wire rope from a core and outer strands, the core being lubricated, comprising:

applying an inner jacket by cold application to the core, the inner jacket being permeable and having pores or voids;

closing the outer strands over the inner jacket to compress the inner jacket; and applying a molten material to the inner jacket to form an integrated jacket that includes the inner jacket, in which the inner jacket includes a floor having a lower porosity than the material of the inner jacket other than the floor.

23. The method of claim 22 in which the inner jacket has an equal or higher melting point than the molten material.

24. The method of claim 22 in which applying a molten material is carried out at least partly while closing the outer strands over the inner jacket.

25. The method of claim 22 in which the molten material migrates into pores or voids of the inner jacket and cools as the molten material passes through the pores or voids of the inner jacket.

26. The method of claim 22 further comprising compressing the inner jacket with the outer strands to fill gaps between the outer strands.

27. The method of claim 22 wherein closing the outer strands is simultaneous with applying the molten material to the outer strands.

28. The method of claim 22 wherein the inner jacket is tubular prior to application to the core.

29. The method of claim 22 wherein the inner jacket has a first porosity above 5 PPI and below 150 PPI before closing of the outer strands over the inner jacket and a second porosity after closing of the outer strands over the inner jacket, wherein the second porosity is lower than the first porosity.

30. The method of claim 29 in which the inner jacket has a porosity below 80 PPI before closing of the outer strands over the inner jacket.

31. The method of claim 29 in which the inner jacket has a porosity below 50 PPI before closing of the outer strands over the inner jacket.

32. The method of 1 in which the floor is impermeable to the molten material.

33. The method of claim 22 in which the integrated jacket at least partly surrounds the outer strands to separate the outer strands.

34. A wire rope, comprising:

a lubricated core;

an inner jacket contacting the core, the inner jacket including an outward facing surface having open pores;

outer strands wrapped around the inner jacket; and an outer jacket at least partly permeated into the open pores of the inner jacket to form an integrated jacket formed of the inner jacket and the outer jacket;

wherein the inner jacket comprises crossing fibrous material.

35. A wire rope, comprising:

a lubricated core;

an inner jacket contacting the core, the inner jacket including an outward facing surface having open pores;

outer strands wrapped around the inner jacket; and an outer jacket at least partly permeated into the open pores of the inner jacket to form an integrated jacket formed of the inner jacket and the outer jacket;

wherein the inner jacket comprises grids of material laid on top of each other.

36. A wire rope, comprising:

a lubricated core;

an inner jacket contacting the core, the inner jacket including an outward facing surface having open pores;

outer strands wrapped around the inner jacket; and an outer jacket at least partly permeated into the open pores of the inner jacket to form an integrated jacket formed of the inner jacket and the outer jacket;

wherein the inner jacket comprises metal.

37. A wire rope, comprising:

a lubricated core;

an inner jacket contacting the core, the inner jacket including an outward facing surface having open pores;

outer strands wrapped around the inner jacket; and an outer jacket at least partly permeated into the open pores of the inner jacket to form an integrated jacket formed of the inner jacket and the outer jacket;

in which the inner jacket comprises layers of different permeability.

38. A wire rope, comprising:

a lubricated core;

an inner jacket contacting the core, the inner jacket including an outward facing surface having open pores;

outer strands wrapped around the inner jacket; and an outer jacket at least partly permeated into the open pores of the inner jacket to form an integrated jacket formed of the inner jacket and the outer jacket;

wherein the inner jacket includes an impermeable layer, the impermeable layer divides the inner jacket into an outer part that is integrated with the outer jacket and an inner part that faces on to the core, and the inner jacket has at least a first layer having a first permeability and a second layer having a second permeability, the first layer is adjacent the core, and the first permeability is lower than the second permeability.

39. A wire rope, comprising:

a lubricated core;

an inner jacket contacting the core, the inner jacket including an outward facing surface having open pores;

outer strands wrapped around the inner jacket; and an outer jacket at least partly permeated into the open pores of the inner jacket to form an integrated jacket formed of the inner jacket and the outer jacket;

in which the inner jacket comprises aramid fibers.

40. A wire rope, comprising:

a lubricated core;

an inner jacket contacting the core, the inner jacket including an outward facing surface having open pores;

outer strands wrapped around the inner jacket; and an outer jacket at least partly permeated into the open pores of the inner jacket to form an integrated jacket formed of the inner jacket and the outer jacket;

in which the material of the outer jacket penetrates all of the inner jacket.

41. A wire rope, comprising:

a lubricated core;

an inner jacket contacting the core, the inner jacket including an outward facing surface having open pores;

outer strands wrapped around the inner jacket; and an outer jacket at least partly permeated into the open pores of the inner jacket to form an integrated jacket formed of the inner jacket and the outer jacket;

in which the lubricated core has an indented profile, and the outer jacket penetrates the open pores of the inner jacket to a greater extent than the inner jacket penetrates the indented profile of the core.

42. A method of constructing a wire rope from a core and outer strands, the core being lubricated, comprising:

applying an inner jacket by cold application to the core, the inner jacket being permeable and having pores or voids;

closing the outer strands over the inner jacket to compress the inner jacket; and applying a molten material to the inner jacket to form an integrated jacket that includes the inner jacket;

wherein the inner jacket is tubular prior to application to the core.

43. A method of constructing a wire rope from a core and outer strands, the core being lubricated, comprising:

applying an inner jacket by cold application to the core, the inner jacket being permeable and having pores or voids;

closing the outer strands over the inner jacket to compress the inner jacket; and applying a molten material to the inner jacket to form an integrated jacket that includes the inner jacket;

wherein the inner jacket has a first porosity above 5 PPI and below 150 PPI before closing of the outer strands over the inner jacket and a second porosity after closing of the outer strands over the inner jacket, wherein the second porosity is lower than the first porosity.

44. A method of constructing a wire rope from a core and outer strands, the core being lubricated, comprising:

applying an inner jacket by cold application to the core, the inner jacket being permeable and having pores or voids;

closing the outer strands over the inner jacket to compress the inner jacket; and applying a molten material to the inner jacket to form an integrated jacket that includes the inner jacket;

in which the inner jacket has a porosity below 80 PPI before closing of the outer strands over the inner jacket.

45. A method of constructing a wire rope from a core and outer strands, the core being lubricated, comprising:

applying an inner jacket by cold application to the core, the inner jacket being permeable and having pores or voids;

closing the outer strands over the inner jacket to compress the inner jacket; and applying a molten material to the inner jacket to form an integrated jacket that includes the inner jacket;

in which the inner jacket has a porosity below 50 PPI before closing of the outer strands over the inner jacket.

* * * * *